US005517755A

United States Patent [19]

Wright

[11] Patent Number: 5,517,755

[45] Date of Patent: May 21, 1996

[54] METHOD FOR MAKING A LITZ WIRE CONNECTION

[75] Inventor: Harold O. Wright, Vermilion, Ohio

[73] Assignee: Reltec Corporation, Lorain, Ohio

[21] Appl. No.: 225,909

[22] Filed: Apr. 8, 1994

[51] Int. Cl.[6] ..... H01R 9/03

[52] U.S. Cl. ..... 29/843; 29/461

[58] Field of Search ..... 29/843, 871, 872, 29/461, 860, 735, 745, 749; 228/180.5; 174/74 R, 15.6

[56] References Cited

U.S. PATENT DOCUMENTS

| | | | |
|---|---|---|---|
| 4,268,957 | 5/1981 | Sbuelz | 29/871 |
| 4,412,201 | 10/1983 | Glasauer et al. . | |
| 4,475,053 | 10/1984 | Mayer . | |
| 4,631,808 | 12/1986 | Jones | 29/871 X |
| 4,963,694 | 10/1990 | Alexion et al. . | |

OTHER PUBLICATIONS

New England Electric Wire Coporation, "Suggested Soldering Techniques For Litz Conductor", May 26, 1992.

*Primary Examiner*—Peter Vo

*Assistant Examiner*—Khan V. Nguyen

*Attorney, Agent, or Firm*—Fay, Sharpe, Beall, Fagan, Minnich & McKee

[57] ABSTRACT

A litz wire connector assembly and method is set forth. A length of litz wire includes a plurality of individually isolated wire strands. An end portion of the litz wire includes non-insulated end surfaces of the wire strands. A sleeve which has an opening smaller than an area of the litz wire is positioned around a first portion of the litz wire such that the first portion of the litz wire within the sleeve is compressed to an area smaller than the remaining portion of the litz wire. An end connection surface is formed by cutting the remaining portion of the litz wire to expose end surfaces of the first portion of litz wire; wherein the end surfaces of the litz wire are substantially even with the end surface of the sleeve. The end connection surface allows mounting in a compact area onto a conductive surface having a strong electrical and mechanical connection.

10 Claims, 4 Drawing Sheets

FIG. 1a
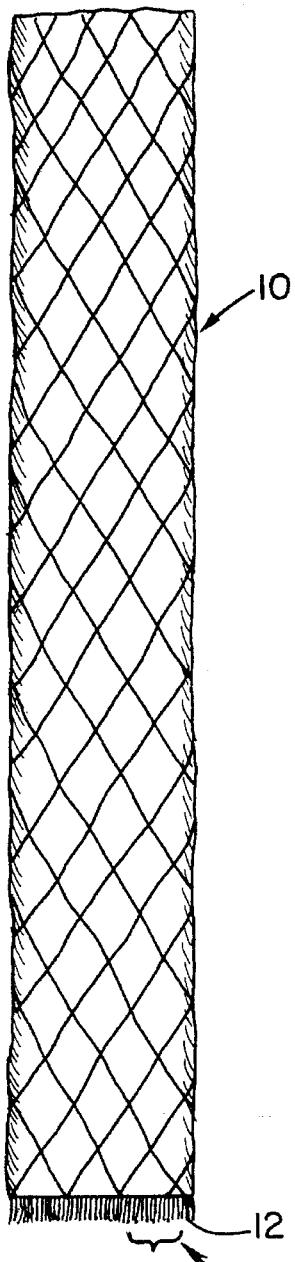
FIG. 1b
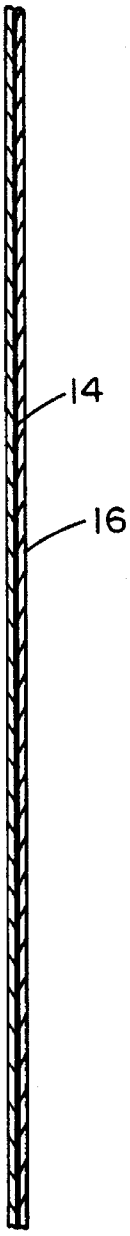
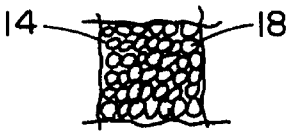
FIG. 1c
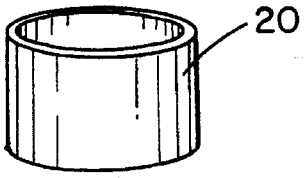
FIG. 2a
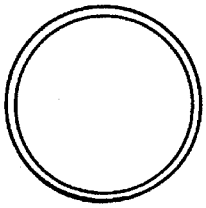
FIG. 2b
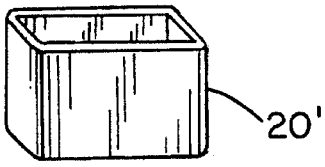
FIG. 3a
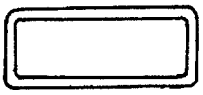
FIG. 3b

METHOD FOR MAKING A LITZ WIRE CONNECTION

BACKGROUND OF THE INVENTION

The present invention relates to a litz wire connector assembly and a method for making such assembly, and more particularly to a method and assembly to connect litz wire to a conductive surface while maintaining the insulative integrity of strands of litz wire to end surfaces to provide a strong mechanical and electrical connection.

At high frequency excitation, such as radio frequencies, current flows near the outside surface of a conductor. This phenomenon is known as "skin effect". This "skin effect" causes current to move away from the center of the conductor and crowd into a layer just beneath the surface. The effect is compounded in a coil, wherein the self-fields of each conductor turn induce current density changes in adjacent turns. In order to lessen the impact of skin effect, standard power wires or cables employ multiple strands of conductors whose cross section is significantly less than that of one larger conductor of the same total area. However, with increasing frequency, the impedance (resistance and inductance) of the stranded wire increases because of current crowding caused by unequal magnetic flux linkages among the individual wires.

For direct current and low frequency alternating current, the conductivity of a wire is proportional to the cross sectional area, or the square of the wire diameter. However, at high frequencies, the conductivity is directly proportional to the diameter of the wire. At high frequencies, it is desirable to maximize the conductor surface area rather than to maximize the cross sectional area of the wire.

To take advantage of these characteristics a wire may be formed by transposing individual wires within small groups of wires and then transposing the groups within the conductor. The immediate effect of this wiring method is to equalize the flux linkages of each individual strand, thus causing the current to divide evenly among the strands.

Litz wire is designed with these principles in mind. It is a conductor composed of a number of fine separately insulated strands interwoven in specific arrangements. The wire is fabricated so that all inner strands come to the outside at regular intervals, and all outer strands go to the center at equal intervals. Litz wire is basically a stranded, interwoven wire in which the conductors are insulated from each other.

It can come in numerous configurations such as a wire of sixteen (16) bundles with twenty-four (24) wire strands in each bundle. In another typical arrangement there are five (5) to nineteen (19) strands within a group. Groups are then bunched together, typically five (5) to seven (7) in a bunch. Then, bunches may be joined together, typically four (4) to seven (7) in a cable. Each of these configurations involve a helical twisting of the elements within the group. The "lay" of the wire can be tight or loose, depending on the pitch of the helical transposition.

Litz wire exhibits low losses at radio frequencies as the conducting surface area is much greater than that of an ordinary solid wire of the same diameter.

As noted above, each strand is individually insulated from other strands of the wire. Though this individual isolation is necessary for the proper functioning of the litz wire it creates a problem when the litz wire is to be terminated to a conductive surface, such as for example the surface of a printed circuit board. Particularly, in a litz wire having sixteen (16) bundles with twenty-four (24) strands in a bundle each of the individual strands are of a small diameter and there are a large plurality of these strands combined to form the litz wire. In order to develop an electrical connection between the litz wire and the conductive surface, it has in the past been common to strip or otherwise remove a portion of the insulation from the length of the strands.

Various litz wire terminations have been proposed. U.S. Pat. No. 4,412,201 to Glasauer, et al. discloses attachment of litz wire (pigtail) is accomplished by crimping it into an end of a sleeve. The litz wire lays in a groove and is captured by teeth which bite into its insulation from the inside surface of a cover thereby providing strain relief. U.S. Pat. No. 4,963,694 to Alexion, et al. is for a connector assembly for internally-cooled litz-wire cable. U.S. Pat. No. 4,475,053 to Mayer is for a brush holder for electrical machines and shows that the litz leads of brushes are resistance welded to a busbar.

Of further interest with regard to connection techniques for litz wire is a paper entitled, *Suggested Soldering Techniques For Litz Conductors* from New England Electric Wire Corporation having a date of May 26, 1992. The issuer of this paper notes they have been manufacturers of specialty wires for over ninety (90) years.

The suggested connection techniques cited in this paper include immersing a selected amount of litz wire into a solder pot at a high enough temperature to remove enamel (i.e. insulation) from the individually insulated strands of the wire. There is also a suggestion to use liquid flux to assist in the preparation of the litz wire. An alternative to removal by solder is the use chemical strippers which dissolve the insulation on the individual strands. A liquid and gel formulation are discussed.

The above patents and article provide various suggestions for termination of litz wire. However, the patents to Alexion, et al. and Glasauer, et al. require fairly complex mechanical construction in order to accomplish the connection. Additionally, these elements are bulky requiring a large area for the termination. The patent to Mayer, which disclosed litz leads may be resistance welded, does not clearly set forth how this is to be accomplished. It would, however, appear important to remove the insulation from the individual strands prior to welding. Also, these documents are not directly concerned with termination of litz wire to a circuit board.

The methods disclosed in, *Suggested Soldering Techniques For Litz Wire Conductors* include the drawbacks of requiring large amounts of solder and other toxic chemicals such as rosin flux and isopropyl alcohol, as well as chemicals used to chemically strip the insulation from the wire strands. Since these methods include chemicals which are dangerous to humans they require safeguards both for those who use the materials and for the storage of these materials. These features increase the complexity and costs of such methods.

A further drawback of the techniques now being used to terminate litz wire is the necessity to strip away insulation of the individual strands of litz wire. By this action the insulative integrity of the litz wire may be degraded. Particularly, lengths of the strands of litz wire which are stripped and, therefore, no longer insulated from each other will result in inductive linkage between the strands in an undesirable manner.

An additional drawback of the known soldering techniques is the use of a wrapping post to wrap the stripped wires around and to which they are then soldered. During this operation some strands may break due to stress placed on the individual strands, causing a loss of conduction. Further, if a post is used a significant amount of space is required.

When using solder in a solder pot to strip the insulation from the individual strands, it is necessary to maintain the solder at an extremely high temperature. When the solder is at this high temperature, chemical reactions occur where a tinning or tin replacement phenomenon occurs. In this situation, replacement of copper (i.e. the metal used for the litz strands) by the tin element of the solder takes place. If acid is used to strip the insulation material, it is then necessary to dip the stripped strands into a neutralizer and then clear water which complicates the steps required in the stripping process.

In view of the above, it is desirable to develop a simple compact assembly and a method for producing such an assembly. This desired assembly would not require the use of large amounts of toxic chemicals which can cause not only physical damage to users but also damage to the environment. The assembly and method should also result in a compact mechanically simple assembly which is economical to produce and provides a strong electrical and mechanical connection to a conductive surface. The subject invention provides these and other benefits not previously available.

SUMMARY OF THE INVENTION

A method of attaching litz wire including a litz wire assembly to a conductive surface is provided. A length of litz wire with the strands individually insulated up to end surfaces is grasped. A metallic sleeve is positioned on a first section of the length of litz wire with an amount of the litz wire extending through the metallic sleeve. The first section of the length of litz wire is bundled within the metallic sleeve. The bundled first section has a diameter smaller than a diameter of an unbundled second section of the length of litz wire. The length of litz wire which extends through the metallic sleeve is then removed. The remaining end surfaces of the litz wire consists of exposed non-insulated metal substantially even with an end surface of the metallic sleeve. The non-insulated end surfaces of litz wire and end surface of the metallic sleeve form a uniformed non-insulated end connection surface. The end connection surface is connected to a conductive surface by applying solder and heat to form a soldered connection.

A principle advantage of the invention resides in maintaining insulative integrity of the strands of the litz wire out to the end connection surface.

Another advantage is found in a compact connection which minimizes the surface area required and reduces the resistance at the connection point.

Yet another advantage is maintaining the flexible nature of the length of litz wire while at the same time having a strong mechanical connection where stress and strain at the connection point is minimized.

Still other advantages and benefits of the invention will become apparent to those skilled in the art upon a reading and understanding of the following description.

BRIEF DESCRIPTION OF THE DRAWINGS

The present invention may take form in various parts and arrangements of parts or in various steps and arrangements of steps. The drawings are only for purposes of illustrating a preferred embodiment and are not to be construed as limiting the invention.

FIG. 1*a* is a diagrammatic illustration of a length of litz wire having an end portion;

FIG. 1*b* shows an enlarged view of one strand of the strands comprising litz wire shown in FIG. 1*a;*

FIG. 1*c* is a bottom view of a portion of FIG. 1*a* depicting the individual end surfaces of the individual strands of FIG. 1*a;*

FIGS. 2*a*–2*b* are perspective and bottom views of one embodiment of the sleeve of the present invention;

FIGS. 3*a*–3*b* are perspective and bottom views of a second embodiment of a sleeve according to the present invention;

DETAILED DESCRIPTION OF THE PREFERRED EMBODIMENT

Figure 4A:
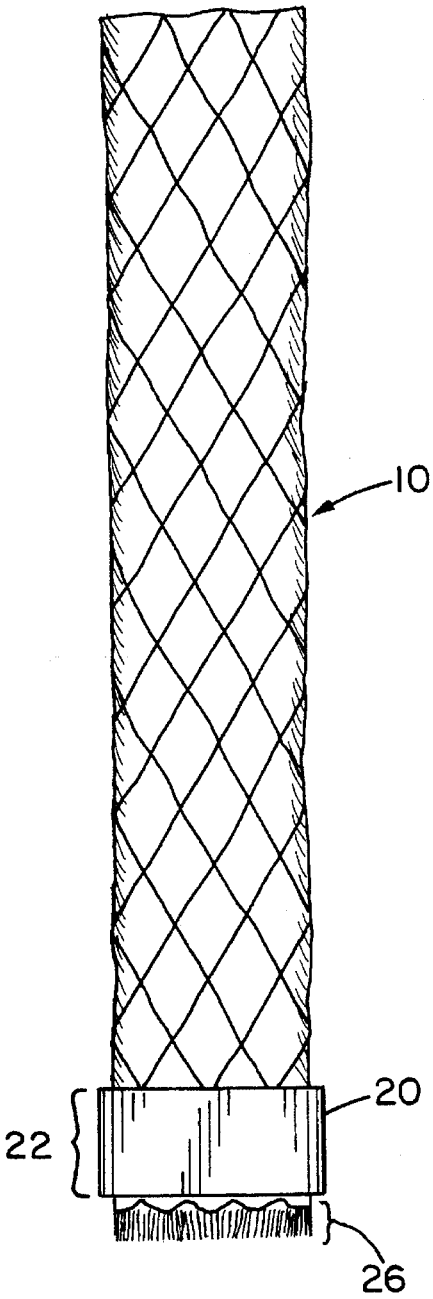
FIGS. 4*a*–4*b* illustrate a litz wire having a sleeve positioned thereon and the sleeve in a compressed state.

With attention to FIG. 1*c*, a length of litz wire 10 is depicted. An end section 12 of this litz wire shows ends of the individual strands of each litz wire. As can be seen by this drawing, the strands are not normally even in their length. Thus, the end section 12 may have a ragged uneven profile. It is to be appreciated that the present invention may also be implemented with a length of wire which has a uniformly cut end section 12.

FIG. 1*b* is an enlarged representation of a single strand 14 of litz wire. This single strand 14 is a wire commonly made from copper. Surrounding and attached to the copper wire is insulation (such as enamel) 16. Each of the strands which comprise the litz wire are individually insulated. In the present embodiment a litz wire having sixteen (16) bundles of twenty-four (24) wires or strands each is being considered. The strands of this litz wire are each very fine and, therefore, the individual strands themselves are fragile. It is to be appreciated that various sizes of litz wire including various types of bundles may be implemented with the present invention. A selected group of end surfaces 18, which are the non-insulated ends of the plurality of strands 14 are depicted in FIG. 1*c*.

FIGS. 2*a*–2*b* show perspective and bottom views of a sleeve 20 according to an embodiment of the present invention. Sleeve 20 may be of a circular configuration. Alternatively, as shown in FIGS. 3*a*–3*b* other types of configurations such as a rectangular sleeve 20' may be implemented. The sleeve may also be constructed in various forms, such as a split ring type arrangement. It may also in some instances be desirable to use a sleeve which is adjustable. Such an adjustable sleeve could include a screw, where turning the screw one direction decreases the inner area and turning the screw in the other direction will widen the inner area.

It is also considered in the present invention that the sleeve is made of a conductive material. However, there may be some instances where a conductive material is not desirable, in such a situation a sleeve made of such material may be substituted.

Figure 4B:
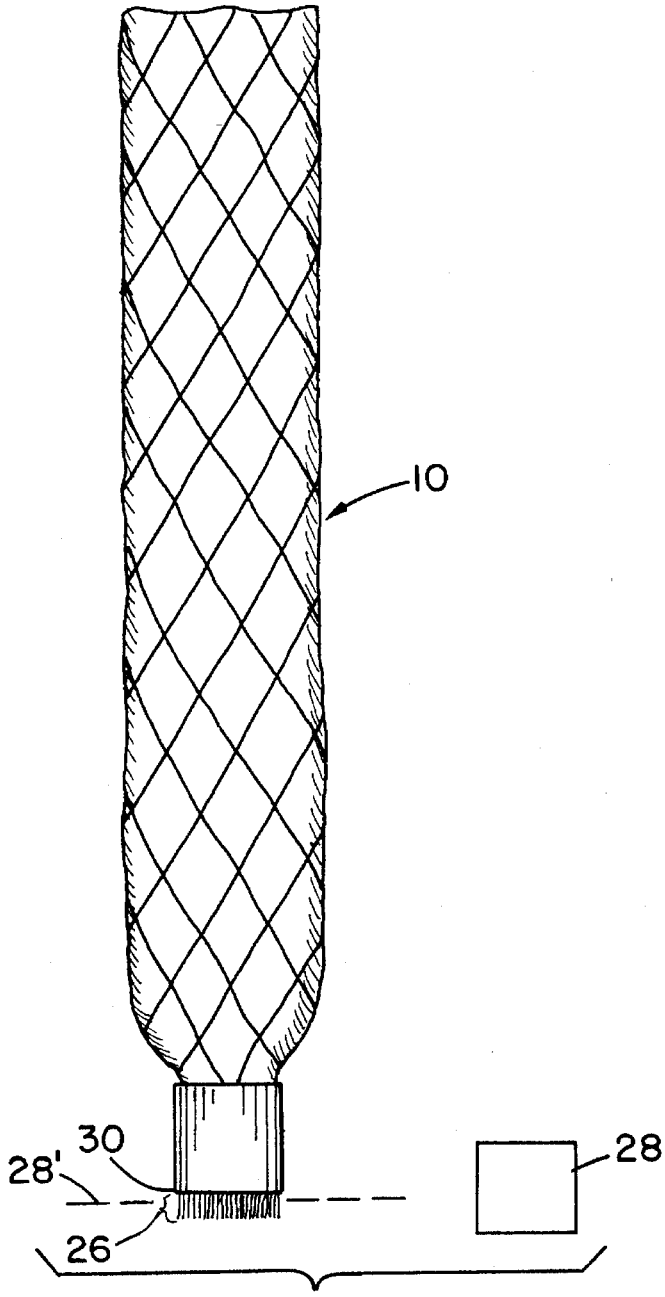

FIGS. 4*a*–4*b* set forth the placement of the sleeve 20 on a first portion 22 of litz wire 10. In this embodiment the sleeve is large enough to slide over the wire without compressing the wire. After the sleeve has been positioned, then the sleeve may be compressed such as crimping or known means in which the inner area of the sleeve is decreased, thereby compressing and securely holding the first portion 22 of litz wire. After the wire 10 has been compressed, the first portion 22 is of a diameter smaller than the unbundled portion 24.

Figure 5A:
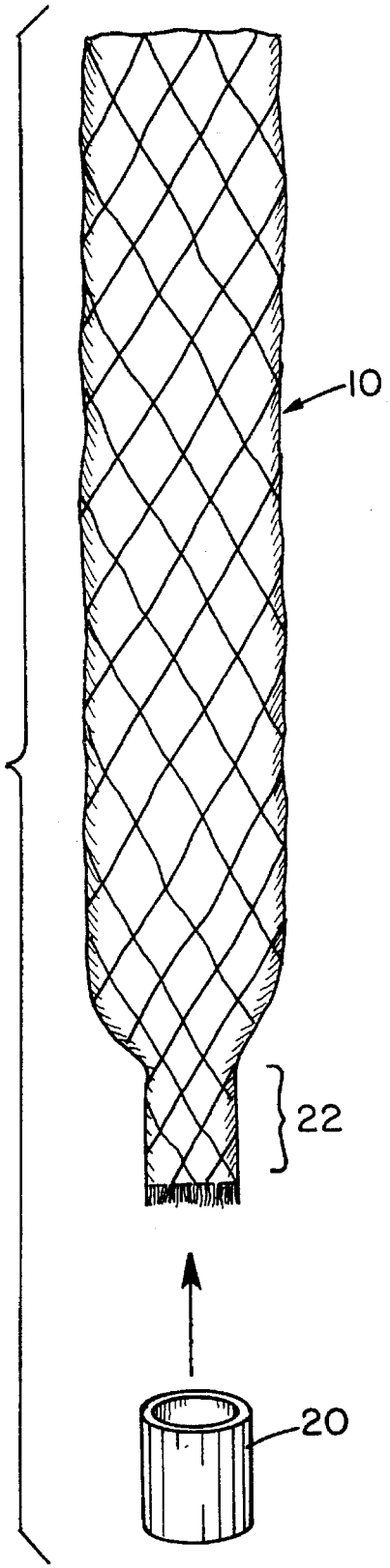
FIGS. 5*a*–5*b* depict a first portion of a litz wire pre-compressed and a sleeve positioned onto the pre-compressed litz wire.
Figure 5B:
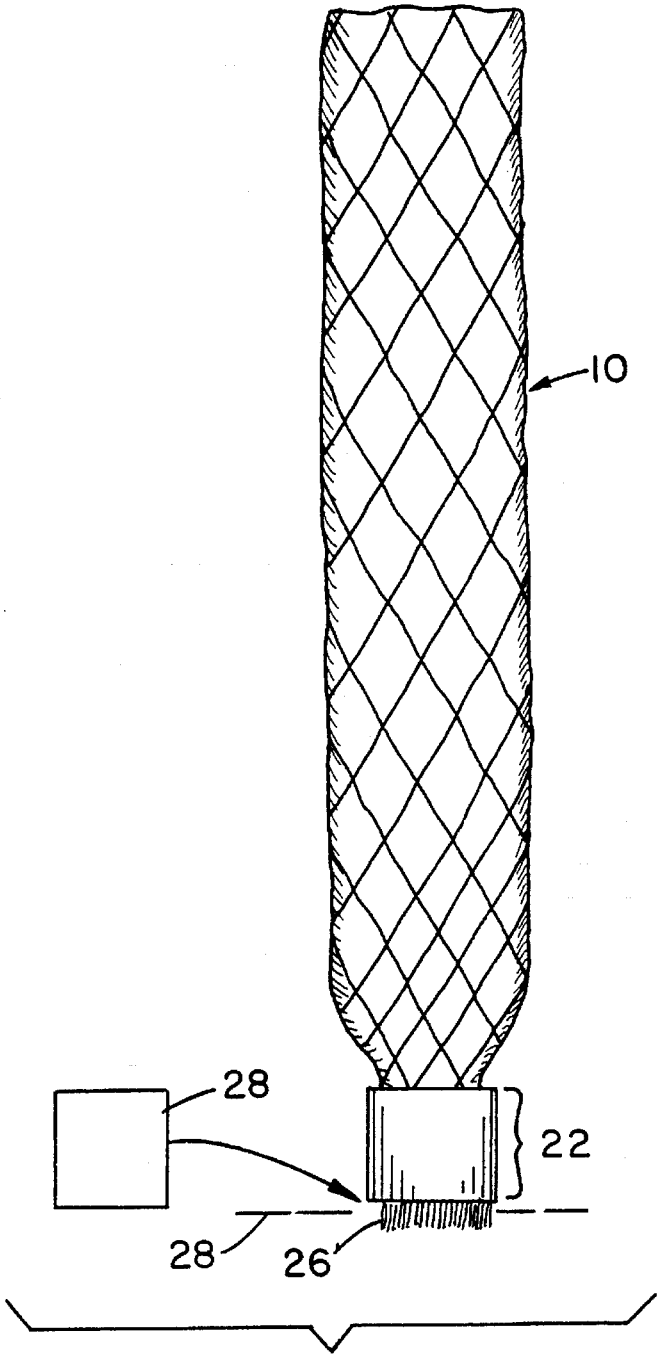

Another manner of attachment between the sleeve 20 and litz wire 10 is shown in FIGS. 5*a*–5*b*. In this arrangement the first portion 22 is pre-compressed by a compressing device. This compressing device may be in the nature of a vice, clamp, etc. or may simply be an individual pressing the wire together. In this pre-compressed stage the sleeve 20 is moved onto the first portion 22. The pre-compression is removed and the wire expands out pressing against the sleeve. In this arrangement the wire is bundled and held securely as shown in FIG. 5*b*.

In either embodiment an extending litz wire portion 26 of the litz wire extends through the sleeve 20. Once the litz wire is held securely by sleeve 20, a cutting device 28 is used to remove the extending litz wire portion 26 along cutting line 28'. This removing is done by cutting the strands of litz wire such that end surfaces, or new end surfaces 18 will be substantially even with an end portion 30 of sleeve 20 thereby forming an end connection surface 32.

Figure 6A:
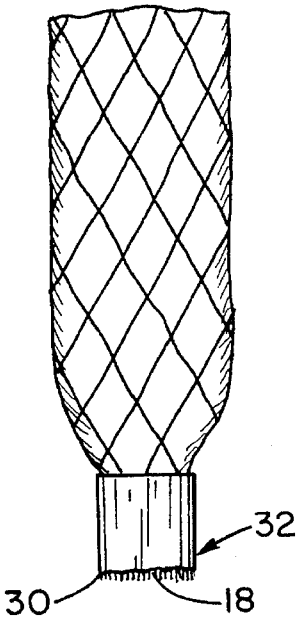
FIG. 6*a* is a side view of a litz wire connection assembly according to the present invention.
Figure 6C:
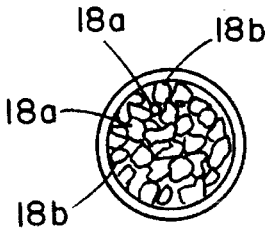
FIGS. 6*c*–6*d* are end views of end connection surfaces having a smeared end connection and a non-smeared end connection.
Figure 6B:
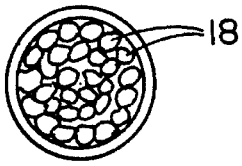
FIG. 6*b* presents a bottom view of the end connection surface of the assembly of FIG. 6*a;*

This end connection surface 32 is more clearly illustrated in FIG. 6*a*. Herein, end portion 30 and the end surfaces 18 form a substantially planar surface. FIG. 6*b* provides a bottom view of the end connection surface 32 which includes the connector 20 with compressed and bundled end surfaces 18.

Figure 6D:
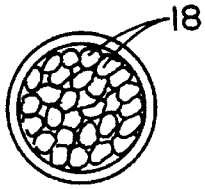

In the removing operation, it is possible that the end surfaces 18 may not be cleanly cut such that the shape of the ends are altered. In otherwords, some of the end surfaces, 18 may be "smeared". This causes an overlap between end surfaces such as between 18*a* and 18*b* as depicted in FIG. 6*c*. Alternatively cutting may be done where the smearing such as shown in FIG. 6*d* does not occur. Smearing can result in some positive benefits as it will present a greater conductive surface area for electrical connection.

Figure 7A:
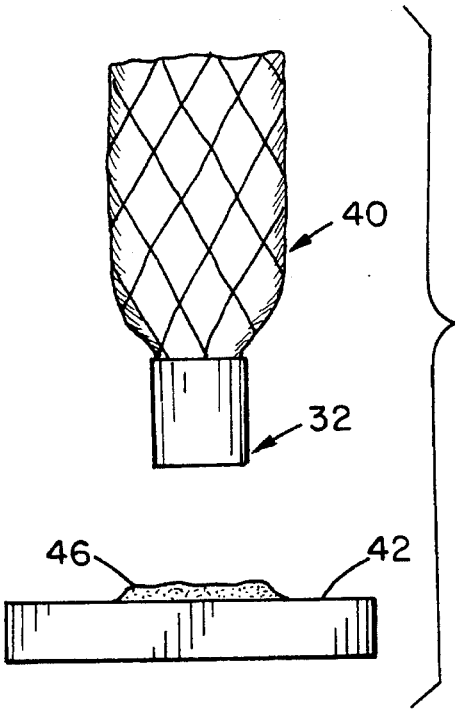
FIGS. 7*a*–7*b* depict an assembly according to the present invention being connected to a conductive surface.
Figure 7B:
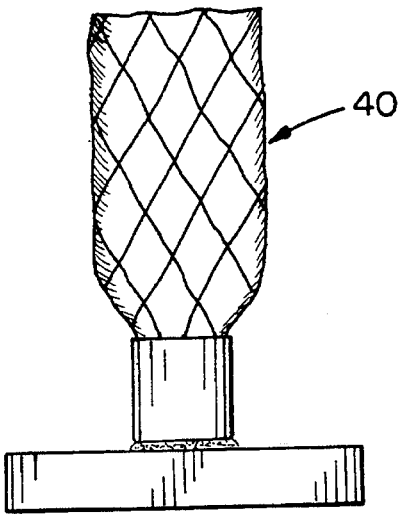

FIGS. 7*a* and 7*b* show the connecting of the litz wire connector assembly 40 and a conductive surface 42. The litz wire connector assembly includes the end connection surface 32. The end connection surface 32 and the conductive surface 42 are connected in the present embodiment by using solder 46 to form a solder connection. FIG. 7*b* depicts an assembly 40 which has been soldered to conductive surface 42 creating an electrical and mechanical connection.

Use of the litz wire connector assembly 40 decreases the surface area needed in forming the connection, which in turn lowers the resistance existing at the connection. This improves the electrical connection and the transmission of signals by the litz wire.

The smaller sized area is also beneficial in the use on circuit boards, as the decreased size of the connection allows a smaller overall circuit board and/or space for more components to be placed on the board.

A further benefit of the present invention, over simply wrapping the litz wire around a wrapping pole, is that a strong mechanical connection is achieved by using the litz wire connector assembly 40. Particularly, the length of litz wire extending from the non-connected end of the the sleeve portion maintains its flexibility and may be moved without causing tension and stress at the connection point.

Still further, the insulative integrity of each individual strand is maintained out to the non-insulated end surface which is in immediate contact with the solder connection. Therefore, the stripping of the length of the wire is avoided in the present invention.

The invention has been described with reference to the preferred embodiments. Obviously modifications and alterations will occur to others upon a reading and understanding of this specification. It is intended to include all such modifications and alterations insofar as they come within the scope of the appended claims or the equivalents thereof.

Having thus described the preferred embodiment we now claim:

1. A method of attaching litz wire having a plurality of wire strands to a conductive surface to form an electrical connection without stripping the wire stands, the method comprising the steps of:

grasping a length of litz wire having a plurality of strands, the strands of the litz wire being individually insulated up to end surfaces;

positioning a first section of the length of litz wire within a sleeve, such that a portion of the litz wire extends through the sleeve;

bundling the first section of the length of litz wire within the sleeve, the bundled first section having a cross-sectional area smaller than a cross-sectional area of an unbundled second section of the length of litz wire;

removing the portion of litz wire which extends through the sleeve to thereby expose new end surfaces of the strands of the litz wire consisting of exposed non-insulated metal substantially even with an end surface of the sleeve, the new end surfaces and the end surface of the sleeve forming a substantially non-insulated end connection surface; and attaching the end connection surface with the conductive surface to form an electrical and mechanical connection, wherein the insulative integrity of the strands of the litz wire is maintained to the end connection surface.

2. The method according to claim 1 wherein the step of positioning includes positioning a sleeve constructed of metallic material.

3. The method according to claim 1 wherein the removing step includes cutting the portion of litz wire extending through the sleeve such that the exposed non-insulated metal of some of the new end surfaces overlap with each other.

4. The method according to claim 1 wherein the bundling step includes compressing the first section of the length of litz wire and the sleeve such that a secure permanent connection is achieved between the sleeve and the first section of the length of litz wire.

5. A method of surface mounting litz wire having a plurality of wire strands to a conductive surface to form an electrical connection without stripping the wire stands, the method comprising the steps of:

grasping a length of litz wire, formed of a plurality of strands insulated up to end surfaces;

positioning a first section of the length of litz wire within a metallic sleeve, with an amount of the litz wire extending through the metallic sleeve;

bundling the first section of the length of litz wire within the metallic sleeve, the bundled first section having a cross-sectional area smaller than a cross-sectional area of an unbundled second section of the length of litz wire;

cutting the amount of litz wire which extends through the metallic sleeve to thereby expose new end surfaces, the new end surfaces of the strands of the litz wire consisting of exposed non-insulated metal in substantially a same plane as an end surface of the metallic sleeve, forming a uniform substantially non-insulated end connection surface including the new non-insulated end surfaces of the strands of litz wire and the end surface of the metallic sleeve; and connecting the end connection surface with the conductive surface, by applying solder and heat to form a soldered connection, wherein the insulative integrity of the strands of the litz wire is maintained to the end connection surface.

6. The method according to claim 5 wherein in the cutting step some of the end surfaces are smeared such that overlap between end surfaces exist.

7. The method according to claim 5 wherein the bundling step includes compressing the metallic sleeve around the first section.

8. The method according to claim 5 wherein the positioning step includes pre-compressing the first section and sliding the metallic sleeve onto the first section.

9. The method according to claim 8 wherein the bundling step includes releasing the first section from compression whereby each of the strands exert force against an interior surface of the metallic sleeve placing the metallic sleeve in secure connection with the first section.

10. The method according to claim 8 wherein the bundling step includes compressing the metallic sleeve, thereby further compressing the first section and placing the first section and metallic sleeve in secure connection.

* * * * *